US008887794B2

(12) United States Patent
Sobota et al.

(10) Patent No.: US 8,887,794 B2
(45) **Date of Patent: *Nov. 18, 2014**

(54) PROCESS AND APPARATUS FOR CASTING A PISTON FOR AN INTERNAL COMBUSTION ENGINE

(75) Inventors: Isabella Sobota, Nuremberg (DE); Robert Sellner, Langenzenn (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/637,501

(22) PCT Filed: Mar. 24, 2011

(86) PCT No.: PCT/EP2011/054531

§ 371 (c)(1), (2), (4) Date: Dec. 21, 2012

(87) PCT Pub. No.: WO2011/117343

PCT Pub. Date: Sep. 29, 2011

(65) Prior Publication Data

US 2013/0092342 A1 Apr. 18, 2013

(30) Foreign Application Priority Data

Mar. 26, 2010 (DE) ..... 10 2010 003 345

(51) Int. Cl.

| | |
|---|---|
| ***B22D 15/02*** | (2006.01) |
| ***B22D 27/04*** | (2006.01) |
| ***B22D 25/02*** | (2006.01) |
| ***B22D 30/00*** | (2006.01) |
| ***B22D 29/00*** | (2006.01) |
| ***B22D 17/22*** | (2006.01) |

(52) U.S. Cl.

CPC ..... *B22D 25/02* (2013.01); *B22D 27/04* (2013.01); *B22D 15/02* (2013.01); *B22D 30/00* (2013.01); *B22D 29/00* (2013.01); *B22D 17/2218* (2013.01)

USPC ..... 164/125; 164/348

(58) Field of Classification Search

CPC ..... B22D 27/04; B22D 15/02; B22D 25/02

USPC ..... 164/125, 348

See application file for complete search history.

(56) References Cited

U.S. PATENT DOCUMENTS 4,164,920 A * 8/1979 Brinkman ..... 123/499
4,450,610 A * 5/1984 Schaper ..... 29/888.046

(Continued)

FOREIGN PATENT DOCUMENTS

DE 532267 8/1931
DE 3521935 C1 2/1987

(Continued)

*Primary Examiner* — Kevin P Kerns

(74) *Attorney, Agent, or Firm* — Robert L. Stearns; Dickinson Wright, PLLC

(57) ABSTRACT

In a process for casting a piston for an internal combustion engine, boundary layer solidification in the region of the gudgeon-pin bores (12) is followed by the withdrawal of at least one sleeve provided there and the cooling of the region of at least one gudgeon-pin bore (12). An apparatus for casting pistons for internal combustion engines has at least one sleeve which can be withdrawn from the region of a gudgeon-pin bore (12) and a device for cooling the region of the gudgeon-pin bores (12).

9 Claims, 1 Drawing Sheet

(56) References Cited

U.S. PATENT DOCUMENTS

| | | | | |
|---|---|---|---|---|
| 4,804,033 | A * | 2/1989 | Hepworth et al. | 164/97 |
| 5,388,632 | A | 2/1995 | Bayliss | |
| 8,720,528 | B2 * | 5/2014 | Stephan et al. | 164/125 |
| 2001/0030035 | A1 * | 10/2001 | Oda | 164/100 |

FOREIGN PATENT DOCUMENTS

| | | | |
|---|---|---|---|
| DE | 102005027540 | A1 | 12/2006 |
| DE | 102008048761 | A1 | 3/2010 |
| WO | 2006133914 | A1 | 12/2006 |

* cited by examiner

PROCESS AND APPARATUS FOR CASTING A PISTON FOR AN INTERNAL COMBUSTION ENGINE

BACKGROUND OF THE INVENTION

1. Technical Field

The invention relates to a process and an apparatus for casting a piston for an internal combustion engine.

2. Related Art

In pistons of internal combustion engines, the strength of the so-called piston-pin bores, in which the piston pin is accommodated for connection with a piston rod, is of particular importance. The required strength can be achieved in particular by rapid quenching of the casting. According to the current procedure, such quenching only takes place outside the mold, when the piston as a whole has solidified to such an extent that it can be removed from the so-called mold.

DE 10 2005 027 540 A1 relates to a process for the production of a piston for internal combustion engines, in which the casting mould is opened before the melt in the region of a feeder has solidified. The piston can subsequently be removed and cooled outside the casting mold.

SUMMARY DESCRIPTION OF THE INVENTION

The object underlying the invention is to provide a process and an apparatus for casting pistons for internal combustion engines, with which the strength, in particular in the region of the piston-pin bores, can be improved.

Accordingly, after boundary layer solidification in the region of at least one piston-pin bore, at least one sleeve provided there is withdrawn and that region is cooled. As a result, the region of the piston-pin bores, in particular the largely cylindrical inner face thereof, can be cooled and quenched more quickly than is possible with the current procedure, so that the strength in those regions is advantageously increased. To that end, it is necessary to wait for only a certain degree of boundary layer solidification, which allows a sleeve provided there to be withdrawn without jeopardizing the shape of the piston in that region. A sleeve is substantially a largely cylindrical or slightly conical casting core which, during casting, keeps free the space subsequently intended for the piston pin and around which the material that surrounds the subsequent piston-pin bore is accordingly molded. With regard to the expression piston-pin bore, it is to be emphasized that this does not necessarily have to be formed by boring as a procedure according to the process. Rather, it is conventionally two substantially cylindrical openings in which the two ends of a piston pin are accommodated, while the piston rod is located between them in the assembled state.

Accordingly, the material surrounding the piston-pin bores can be cooled and quenched by the procedure according to the invention more quickly than has been possible hitherto, so that more rapid and more directed solidification is possible, which results in increased strength. In other words, the rate of solidification of the piston material in particular in the region of the piston-pin bores is increased, which leads to quenching and increased strength. Furthermore, directed solidification can also be produced by means of the described procedure in other regions of the piston.

It is at present preferred to carry out cooling of the piston-pin bores by means of compressed air. Initial considerations have shown that the compressed-air lines required therefor can be provided for all sizes of piston, in particular diesel pistons.

It is further preferred in this connection that a cooling agent that is to be supplied, in particular compressed air, is supplied through at least one core provided between the piston-pin bores and/or through at least one sleeve. Such a core or sleeve has sufficient space, even in the case of small piston types, for compressed-air lines and nozzles or openings to be provided. In particular, the core can advantageously have at least one outlet opening for the cooling medium pointing towards the respective sleeve. There are preferably provided on the core on at least one side, preferably on both sides, two openings, in particular in the form of bores, which are arranged "one behind the other" according to the representation shown in the accompanying figures discussed hereinbelow and which consequently are visible in the figures as only one bore. In other words, the two bores are in different places in the radial direction and, for example, symmetrical relative to the piston axis. Furthermore, a common supply line or separate supply lines to the different bores can be present.

The start of the supply of cooling agent can be initiated particularly efficiently if the above-mentioned outlet openings are freed by the withdrawal of the particular sleeve in question.

It has further been found to be advantageous to configure such a core to be withdrawable. As a result, in particular after initial cooling of the region of the piston-pin bores, further cooling agent, in particular compressed air, can be supplied through the core, preferably to a lesser extent, so that the region between the piston-pin bores can also be cooled. In other words, the core is not withdrawn at first, and the material that is in contact with the core until the core is withdrawn is cooled in order to achieve increased strength there too. Cooling agent can subsequently be supplied simultaneously by way of the core and at least one sleeve. Alternatively, it has been found to be advantageous, after the core has been withdrawn, for cooling of the core space, that is to say the region which is in contact with the core until it is withdrawn, to be carried out by supplying cooling agent through only one sleeve. Cooling to a lesser extent can accordingly be effected by supplying cooling agent, in particular compressed air, through precisely one sleeve.

The object mentioned above is further achieved by the casting apparatus having at least one sleeve, which can be withdrawn from the region of a piston-pin bore, and a device for cooling the region of the piston-pin bores. The advantages mentioned above can be achieved by such an apparatus. The preferred embodiments of the apparatus according to the invention correspond to the process features described above.

BRIEF DESCRIPTION OF THE DRAWINGS

A preferred exemplary embodiment of the invention is discussed in greater detail below. In the drawings.

DETAILED DESCRIPTION OF A PREFERRED EMBODIMENT OF THE INVENTION

Figure 1:
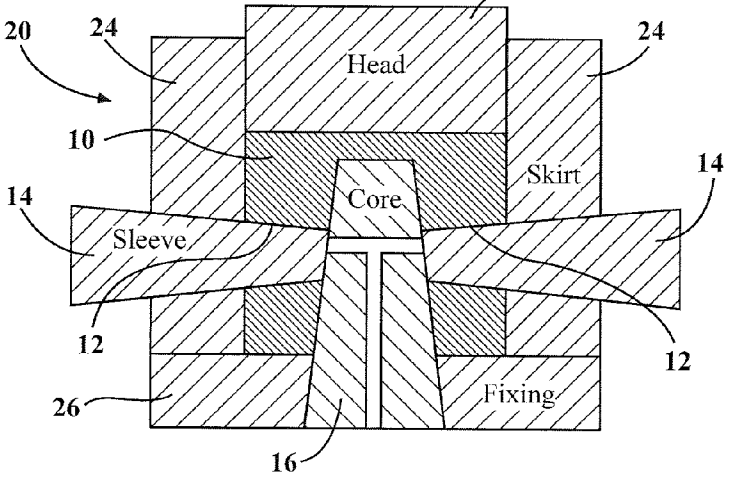
FIG. 1 shows a schematic side view of a casting apparatus with a cast piston during a first solidification phase.

The casting apparatus or mold 20 for a piston 10 shown schematically in section in FIG. 1 has various elements which initially define the outside shape of the piston. That is the case for the tool part 22 in the region of the piston head, the tool parts 24 in the region of the piston skirt, and a so-called fixing ring 26 in the region of the underside of the piston. In order to minimise mechanical reworking in the region of the piston-pin bores 12 as far as possible and to permit withdrawal, two sleeves 14 are provided in the embodiment shown, which sleeves 14 are slightly conical in shape. There is further present a core 16 for keeping free the region between the piston-pin bores 12 which is subsequently to receive the piston rod, which core 16 extends into the region above the pin bores 12 and is contacted by the sleeves. When the material for the piston 10 has been introduced in liquid form into the casting apparatus 20 so configured, solidification of the material takes place, starting from the boundary layers.

Figure 2:
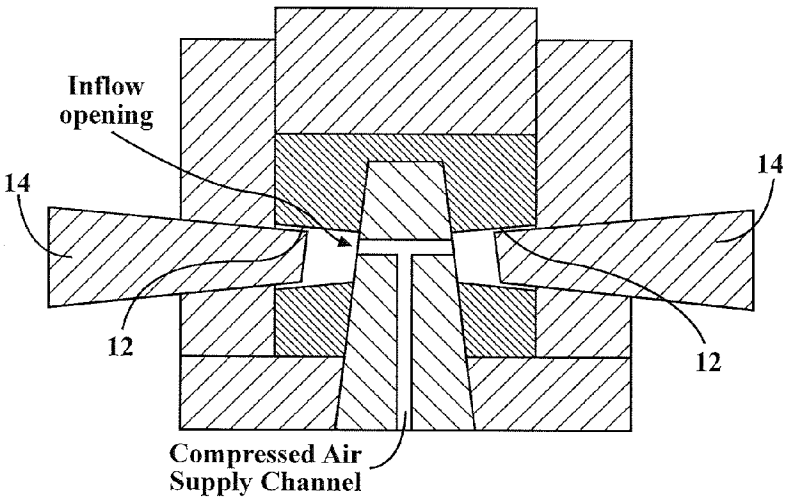
FIG. 2 shows a schematic side view after withdrawal of the sleeves.

As is shown in FIG. 2, after a first boundary layer solidification, which takes place in particular also in the piston-pin bores 12, at least one sleeve 14, in the exemplary embodiment shown both sleeves 14, is withdrawn in order to free the region of the piston-pin bores 12, in particular on the inside thereof. According to the invention, purposive cooling of those inner faces subsequently takes place.

Figure 3:
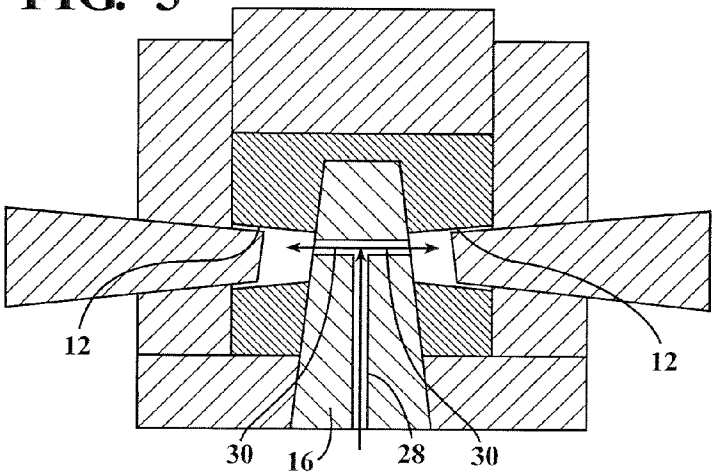
FIG. 3 shows a schematic side view during the supply of compressed air through a tool core.

As is shown in FIG. 3, this is achieved in the exemplary embodiment shown by supplying compressed air through the tool core 16. In particular, the tool core 16 has in the case shown a central feed channel 28 and two lateral channels 30 extending therefrom, so that a generally largely T-shaped configuration of the channels forms. Compressed air flows through the described lateral channels 30 to the inner faces of the piston-pin bores 12, so that they are cooled and quenched and subsequently have increased strength.

Figure 4:
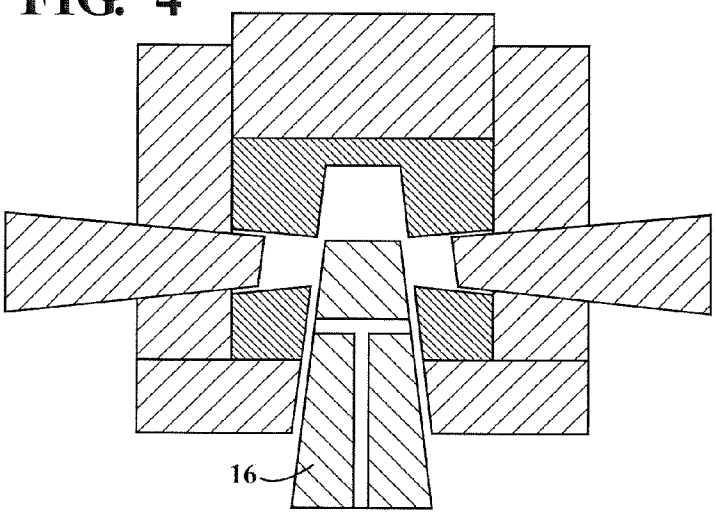
FIG. 4 shows a schematic side view after the tool core has been withdrawn.

In FIG. 4, the preferred procedure is shown, in which the core 16 is subsequently withdrawn in order to free also the inner faces in the region between the piston-pin bores, which hitherto were in contact with the core 16, and to effect cooling and quenching thereto, before the piston as a whole can be removed from the casting apparatus or mold.

The invention claimed is:

1. A process of casting a piston for an internal combustion engine having piston-pin bores, comprising: establishing during casting boundary layer solidification in the region of the piston-pin bores and about, at least one sleeve provided in the region of at least one of the piston-pin bores and about at least one core provided in a region between the piston-pin bores, and wherein the at least one core is provided with at least one cooling agent outlet opening pointing towards the at least one sleeve through which a cooling agent is directed, wherein the at least one cooling agent outlet opening of the core is initially blocked by the at least one sleeve and thereafter freed by withdrawal of the at least one sleeve.

2. The process according to claim 1, wherein the cooling agent is compressed air.

3. The process according to claim 1, wherein after boundary layer solidification in the region between the piston-pin bores, at least one core is withdrawn, and the region between the piston-pin bores is cooled.

4. The process according to claim 3 wherein the cooling imparted by the at least one core is less than that imparted by the at least one sleeve.

5. An apparatus for casting pistons for internal combustion engines, having at least one sleeve, which can be withdrawn from the region of a piston-pin bore, and a device for cooling the region of the piston-pin bores, wherein a cooling agent can be supplied through at least one sleeve and/or at least one core provided between the piston-pin bores, which core has a pair of outlet openings for the cooling agent pointing towards the respective sleeve, which outlet opening is freed by withdrawal of the respective sleeve, and wherein the at least one core includes a through-passage extending between the outlet openings.

6. The apparatus according to claim 5, wherein the at least one core can be withdrawn from the region between the piston-pin bores.

7. The apparatus according to claim 5, wherein the cooling agent is supplied through an opening in the at least one core.

8. The apparatus according to claim 5, wherein the cooling agent is compressed air.

9. The apparatus according to claim 8, including a compressed air supply device for supplying the compressed air.

* * * * *